US008251759B2

(12) United States Patent
Matsunaga

(10) Patent No.: US 8,251,759 B2
(45) Date of Patent: Aug. 28, 2012

(54) TERMINAL FITTING, A TERMINAL FITTING CHAIN, A WIRE WITH A TERMINAL FITTING AND A PROCESSING DEVICE THEREFOR

(75) Inventor: Hideki Matsunaga, Yokkaichi (JP)

(73) Assignee: Sumitomo Wiring Systems, Ltd (JP)

( * ) Notice: Subject to any disclaimer, the term of this patent is extended or adjusted under 35 U.S.C. 154(b) by 415 days.

(21) Appl. No.: 12/558,654

(22) Filed: Sep. 14, 2009

(65) Prior Publication Data

US 2010/0081325 A1 Apr. 1, 2010

(30) Foreign Application Priority Data

Sep. 26, 2008 (JP) ..... 2008-248883

(51) Int. Cl.
*H01R 9/24* (2006.01)

(52) U.S. Cl. ..... 439/885; 439/877

(58) Field of Classification Search ..... 29/884
See application file for complete search history.

(56) References Cited

U.S. PATENT DOCUMENTS 4,411,484 A * 10/1983 Casey ..... 439/422
4,653,187 A * 3/1987 Sowinski ..... 29/884
5,370,560 A * 12/1994 Ito ..... 439/877
5,571,034 A * 11/1996 Seidler ..... 439/876
5,638,438 A 6/1997 Keen
5,772,480 A * 6/1998 Yamamoto et al. ..... 439/885
5,975,959 A * 11/1999 Joly ..... 439/630
6,634,101 B2 * 10/2003 Sato ..... 29/876
6,742,251 B1 6/2004 Fukase
6,827,615 B2 * 12/2004 Axelsson ..... 439/885
2002/0022414 A1 * 2/2002 Kitagawa et al. ..... 439/877
2007/0117476 A1 5/2007 Kumakura

* cited by examiner

*Primary Examiner* — Michael Zarroli
(74) *Attorney, Agent, or Firm* — Gerald E. Hespos; Michael J. Porco

(57) ABSTRACT

A wire with a terminal fitting (10) formed by crimping and cutting a terminal fitting with a carrier in which a terminal fitting (12) projecting forward is coupled to a carrier (C). The wire with the terminal fitting (10) is provided with a crimping portion (30) to be crimped into connection with an end portion of an insulated wire 40 formed by covering a core (42) with a coating (43), a link (13) coupling the crimping portion (30) and the carrier (C), and an escaping portion (35) formed by partly cutting off a rear end part of the crimping portion (30) and enabling a cutting mold (53) for cutting the link portion (13) to be arranged at a position where a front end (53A) of the cutting mold (53) is located before the rear end of the crimping portion (30).

8 Claims, 13 Drawing Sheets

TERMINAL FITTING, A TERMINAL FITTING CHAIN, A WIRE WITH A TERMINAL FITTING AND A PROCESSING DEVICE THEREFOR

BACKGROUND OF THE INVENTION

1. Field of the Invention

The invention relates to a terminal fitting, a terminal fitting chain, a wire with a terminal fitting and a processing device therefor.

2. Description of the Related Art

Terminal fittings 1 before being crimped are generally coupled by a carrier 2, as shown in FIG. 9. The terminal fittings 1 and the carrier 2 are coupled by links 3, as shown in FIG. 10. The terminal fittings 1 are fed to a crimping machine, using the carrier 2, and the carrier 2 is inserted into a cutting mold 4 provided in the crimping machine and a crimping portion 5 of the terminal fitting 1 is arranged on an anvil 6, as shown in FIG. 11. A crimper 7 is arranged above the crimping portion 5 and can be lowered toward the anvil 6 to crimp the crimping portion 5 into connection with an insulated wire 8, as shown in FIG. 12. The cutting mold 4 also is lowered as the crimper 7 is lowered for cutting the link 3. In this way, a wire with a terminal fitting 9 shown in FIG. 13 is formed. Such a wire with the terminal fitting 9 is known, for example, from U.S. Pat. No. 6,742,251.

A front end 4A of the above-described cutting mold 4 is located behind a rear end 5A of the crimping portion 5 to define a clearance between the cutting mold 4 and the crimping portion 5 for avoiding interference between the cutting mold 4 and the crimping portion 5 due to a dimensional error and a displacement of the terminal fitting 1. Accordingly, as shown in FIG. 13, the link 3 projects back at the rear end 5A of the crimping portion 5. The crimping portion 5 is deformed plastically to extend in forward and backward directions when a high compression rate is set for compressing the core. Therefor, a backward projecting distance of the link 3 increases. The terminal fitting 1 is inserted into a housing (not shown). However, the link 3 will project back from the housing due to the plastic deformation of the crimping portion 5. As a result, adjacent wires with terminal fittings 9 may leak due to these projecting parts.

The invention was developed in view of the above situation and an object thereof is to suppress a backward projecting distance of a link.

SUMMARY OF THE INVENTION

The invention relates to a terminal fitting to be connected to a wire by crimping and to be cut from a carrier. The terminal fitting includes a crimping portion to be crimped into connection with an end portion of a wire. The terminal fitting also includes a link that couples the crimping portion and the carrier. An escaping portion is formed by partly cutting off a rear end part of the crimping portion. Thus, a cutting mold for cutting the link can be arranged at a position so that the front end of the cutting mold is located before the rear end of the crimping portion. Accordingly, a backward projecting distance of the link can be suppressed as compared with the case where the link is cut behind the rear end of the crimping portion as before.

The crimping portion preferably includes front and rear crimping pieces that standing up from a bottom wall at positions displaced in forward and backward directions. The front crimping piece preferably is arranged before the front end of the cutting mold, and the escaping portion preferably is formed near the bottom wall in a rear end part of the rear crimping piece. Accordingly, interference of the cutting mold with the front crimping piece can be avoided. Further, it is sufficient to form the escaping portion only in the rear crimping piece and it is not necessary to form the escaping portion in the front crimping piece.

The crimping pieces preferably are of the cross barrel type.

At least one serration preferably is formed in a surface to be held in contact with a core of the wire and can bite in the core. Thus, a film with reduced electric conductivity on the core is scraped off by opening edges of the serration.

The invention also relates to a terminal fitting chain comprising a plurality of the above-described terminal fittings connected to a carrier by links. The link is cut before the rear end of the crimping portion by locating the cutting mold in the escaping portion upon cutting the link using the cutting mold. Thus, a backward projecting distance of the link can be suppressed as compared with the case where the link is cut behind the rear end of the crimping portion as before.

Feed holes preferably are formed in the carrier at positions substantially corresponding to the links and are used to feed the carrier.

The invention also relates to a wire with the above-described terminal fitting formed by crimping and cutting the terminal fitting with a carrier in which the terminal fitting projects forward from and is coupled to a carrier.

The core of the wire may be made of aluminum or aluminum alloy. Thus, the wire with the terminal fitting can be made lighter as compared with the case of using a core made of copper or copper alloy.

The invention also relates to a processing device for crimping a terminal fitting into connection with a wire and for cutting the terminal fitting from a carrier. The processing device has an anvil on which the terminal fitting connected to the carrier via a link is to be placed. At least one crimper is provided movably for crimping a crimping portion of the terminal fitting into connection with an end portion of the wire. A cutting mold is provided for cutting the link that couples the crimping portion and the carrier. The front end of the cutting mold is located before the rear end of the crimping portion by at least partly entering an escaping portion of the terminal fitting formed by partly cutting off a rear end part of the crimping portion.

The crimper preferably comprises a first crimper corresponding to a wire barrel of the crimping portion to be crimped with a core of the wire and a second crimper corresponding to an insulation barrel to be crimped with an insulation coating of the wire.

The cutting mold preferably has a recess that is open toward the front end of the cutting mold so that the carrier can be introduced into the recess.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
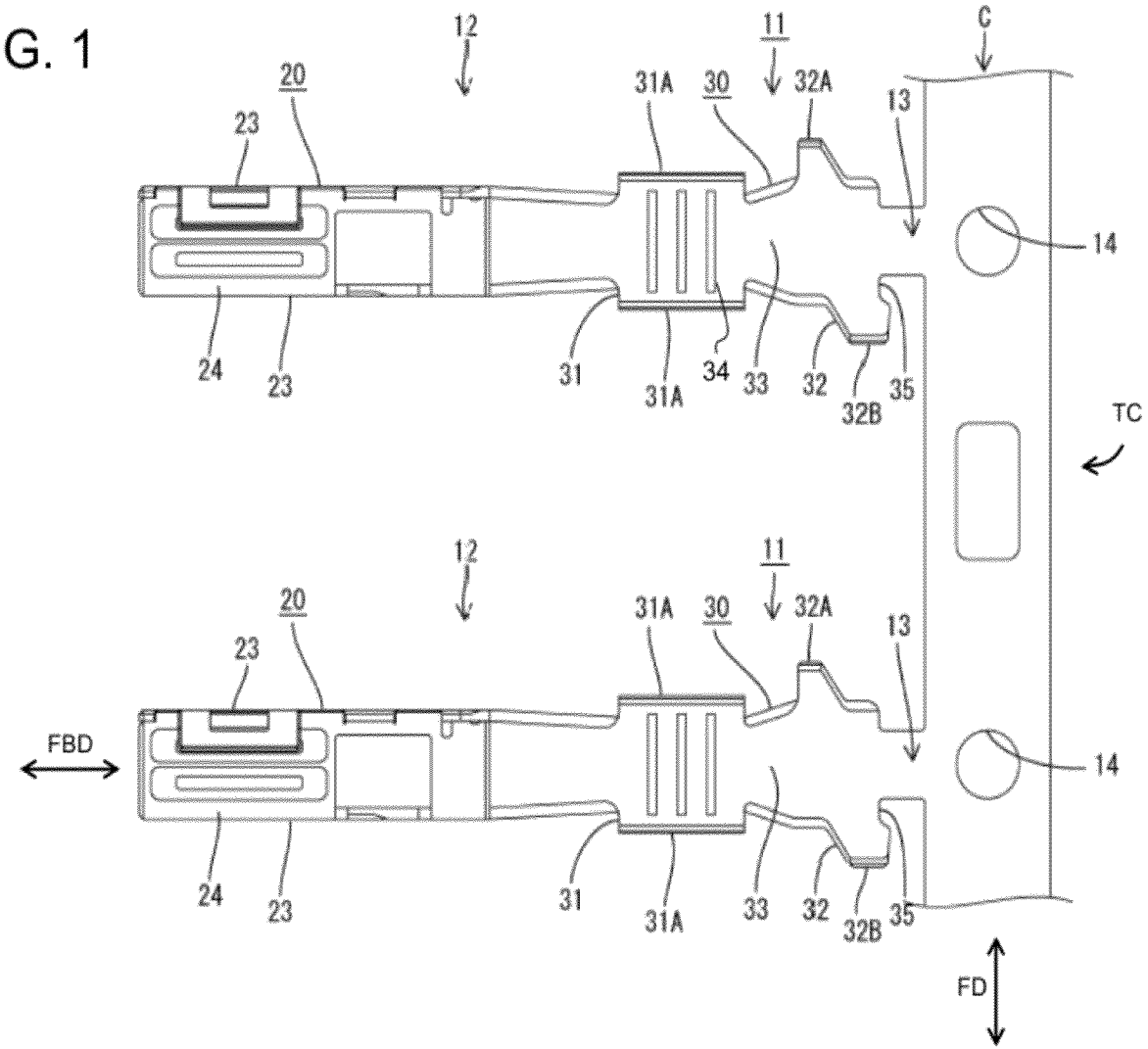
FIG. 1 is a plan view of a terminal fitting coupled to a carrier before being crimped.
Figure 2:
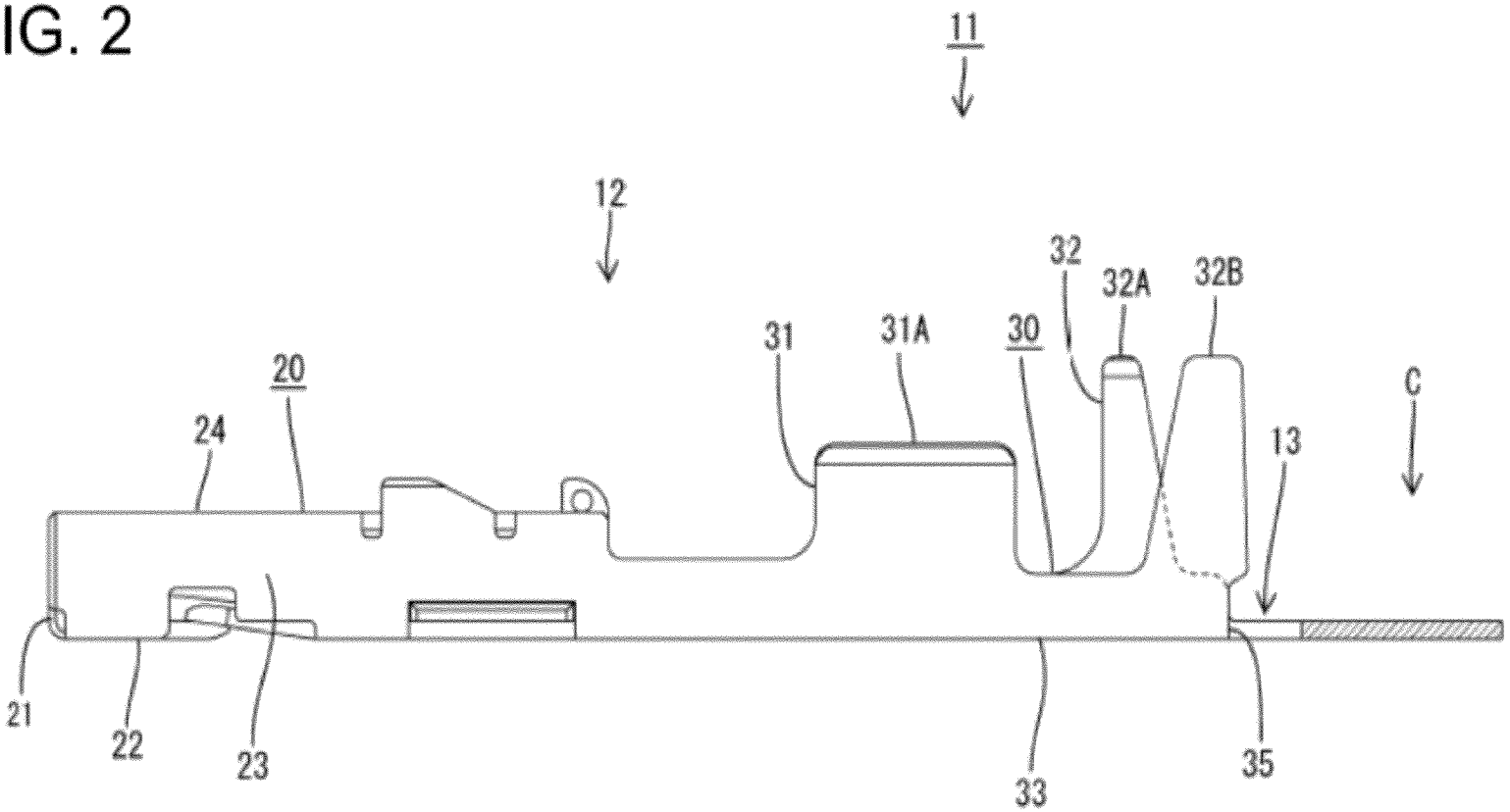
FIG. 2 is a side view of the terminal fitting coupled to the carrier before being crimped.

A terminal fitting in accordance with the invention is identified by the numeral 12 in FIG. 1 and is shown in FIG. 1 before being crimped to a wire. The terminal fitting 12 has a main body 20 in the form of a substantially rectangular tube and a crimping portion 30 behind the main body 20, as shown in FIGS. 1 and 2. Although a female terminal fitting including the tubular main body 20 is illustrated, the invention is equally applicable to a male terminal fitting.

As shown in FIG. 1, terminal fittings 12 are coupled to one lateral edge of a carrier C to define a terminal fitting chain TC. The terminal fittings 12 are arranged at specified intervals along the feeding direction FD of the carrier C and project from the carrier C in a forward and backward direction FBD, which is substantially normal to the feed direction FD. The terminal fittings 12. Links 13 couple the terminal fittings 12 to the carrier C.

Feed holes 14 are formed at positions on the carrier C corresponding to the links 13 and are used to feed the carrier C. The feed holes 14 are substantially round and penetrate the carrier C in a plate thickness direction. A crimping machine 50 (see FIGS. 4 to 6) is provided with feeding shafts (not shown) that are inserted into the feed holes 14 to feed the terminal fittings 11 coupled to the carrier C. An end of an insulated wire 40 is arranged in the crimping portion 30 and then the crimping machine 50 crimps the crimping portion 30 into connection with the wire 40. The carrier C then is separated from the crimping portion 30 to leave an assembly 10 of the wire 40 connected with a terminal fitting 10.

The insulated wire 40 has a core 42 covered by an insulating coating 43 that is made e.g. of synthetic resin. The preferred core 42 is formed by bundling eleven metal strands 41, and the total cross-sectional area of the bundle of the metal strands 41 is about 0.75 $mm^2$. The metal strands 41 may be made of a material more rigid than copper or copper alloy, and preferably are made of an aluminum alloy. However, the core 42 can be formed from other materials, including aluminum, copper or a copper alloy.

The main body 20 includes a base wall 22. Two side walls 23 project from opposite lateral sides of the base wall 22. A ceiling wall 24 formed by bending an upper part of one side wall 23 toward the upper edge of the other side wall 23 so that the ceiling wall 24 faces the base wall 21.

A resilient contact 21 is folded back from the front edge of the bottom wall 22 and extends into the main body 20. A tab-shaped mating conductor (not shown) is insertable between the resilient contact 21 and a surface of the ceiling wall 24 facing the resilient contact 21.

A distance between the resilient contact 21 in a natural or undeformed state and the facing surface of the ceiling wall 24 is smaller than the plate thickness of the mating conductor. Thus, the resilient contact 21 deforms when the mating conductor is inserted between the resilient contact 21 and the ceiling wall 24. Accordingly, the mating conductor and the resilient contact 21 resiliently touch each other and electrically connect.

The crimping portion 30 has a substantially U-shaped wire barrel 31 and a substantially U-shaped insulation barrel 32 arranged behind the wire barrel portion 31. The crimping portion 30 includes a base wall 33 that is continuous with the base wall 22 of the main body 20. The base wall 33 extends substantially in forward and backward directions FBD along an axial direction of the core 42.

The wire barrel 31 has two crimping pieces 31A that project from opposite lateral sides of the base wall 33 to substantially face each other. The wire barrel 31 can be crimped, bent or folded into connection with the core 42 by placing an end portion of the core 42 on the bottom wall 33 along the forward and backward directions FBD and crimping the crimping pieces 31A into connection with the end portion of the core 42. The core 42 and the wire barrel 31 are connected electrically by bringing the core 42 into electrical connection with the crimping pieces 31A and the bottom wall 33.

The insulation barrel 32 has front and rear crimping pieces 32A, 32B that project from opposite lateral sides of the base wall 33. The front and rear crimping pieces 32A, 32B are displaced in forward and backward directions FBD of the terminal fitting 10. The insulation barrel 32 can be crimped, bent, folded or deformed into connection with the core 42 and the coating 43 by placing the coating 43 on the bottom wall 33 and crimping the crimping pieces 32A, 32B into connection with the coating 43.

An insulating film (e.g. aluminum hydroxide or aluminum oxide) will form on the outer surface of the core 42 e.g. by reaction with water and oxygen in air. A problematic large contact resistance may exist if the core 42 and the wire barrel 31 are connected with the film present therebetween. Accordingly, serrations 34 are formed in a surface to be held in contact with the core 42. The serrations 34 bite in the core 42 and opening edges of the serration 34 scrape off the film. The serrations 34 are grooves in the wire barrel 31 and extend in a width direction that is substantially normal to forward and backward directions FBD. Additionally, the serrations 34 are spaced apart in forward and backward directions FBD.

The wire barrel 31 is crimped at a higher compression rate than in the case of using a core made of copper alloy to remove the film, increase a contact area with an inner conductor (e.g. aluminum alloy layer) and reduce the contact resistance. However, the higher compression rate causes the wire barrel 31 to deform plastically and elongate in forward and backward directions FBD. The elongation of the wire barrel 31 may cause the rear ends of the links 13 to project back from the rear ends of the rear crimping pieces 32*b*. Hence, the links 13 may project back from cavities (not shown) of a connector housing and may hinder adjacent wires or impede insertion of the terminal fittings 10 into the cavities.

Accordingly, the link 13 is cut at or before the rear end of the rear crimping piece 32B to reduce a backward projecting distance of the link 13. Hence, an escaping portion 35 is formed to arrange a front end 53A of a cutting mold 53 for cutting the link 13 at or before the rear end of the rear crimping piece 32B in the crimping machine 50.

Figure 3:
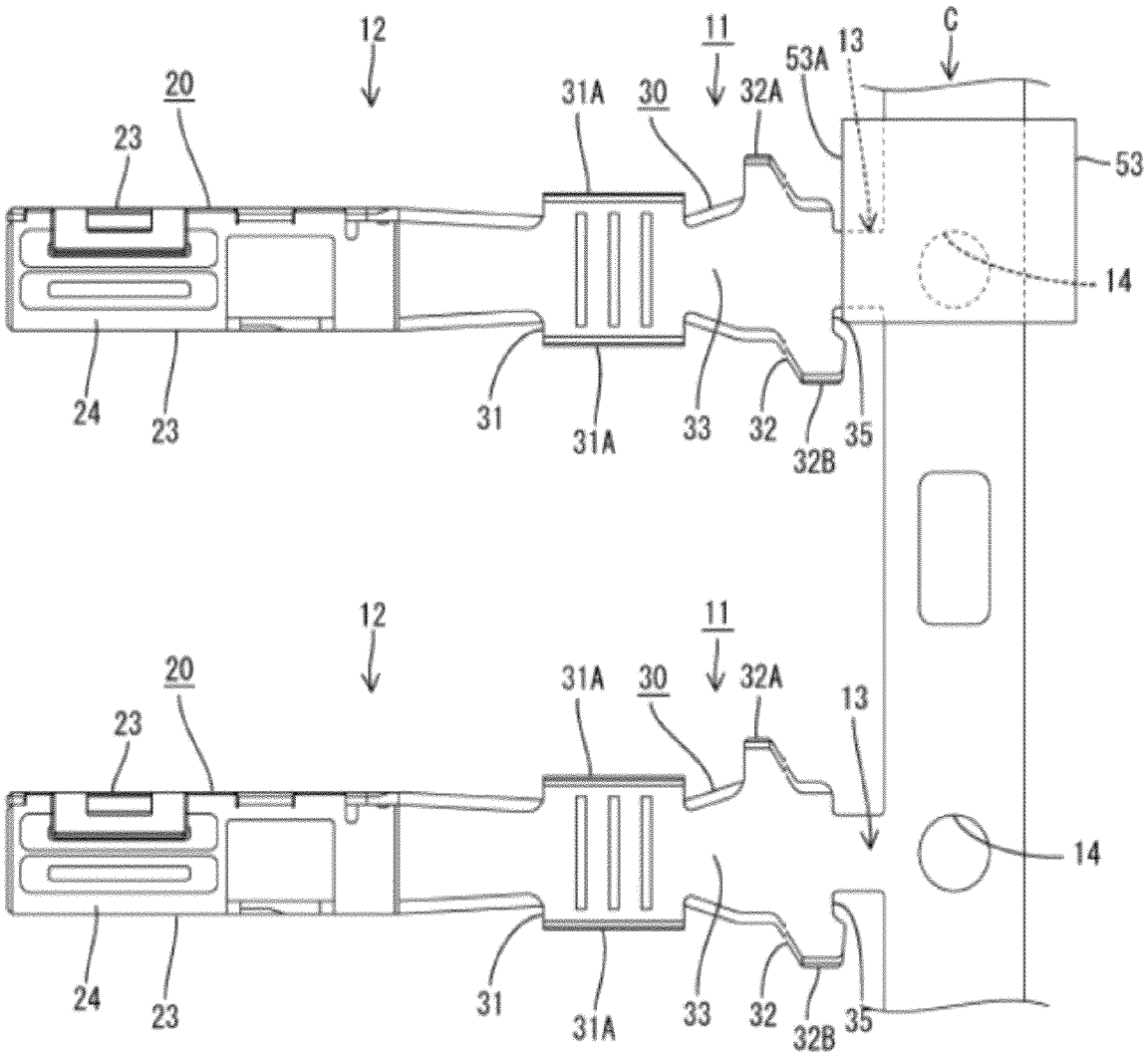
FIG. 3 is a plan view showing a state where a cutting mold is arranged in an escaping portion.

The escaping portion 35 is formed by partly cutting off a rear end part of the rear crimping piece 32B near the bottom wall 33. As shown in FIG. 3, the front end 53A of the cutting mold 53 is located in the escaping portion 35 and before the rear end of the rear crimping piece 32B. Accordingly, the link 13 can be cut before or at the rear end of the rear crimping piece 32B while avoiding the interference of the cutting mold 53 with both crimping pieces 32A, 32B. As a result, the backward projecting distance of the link 13 can be suppressed, with the result that backward projection of adjacent wires with the terminal fittings 10 can be restricted.

Figure 5:
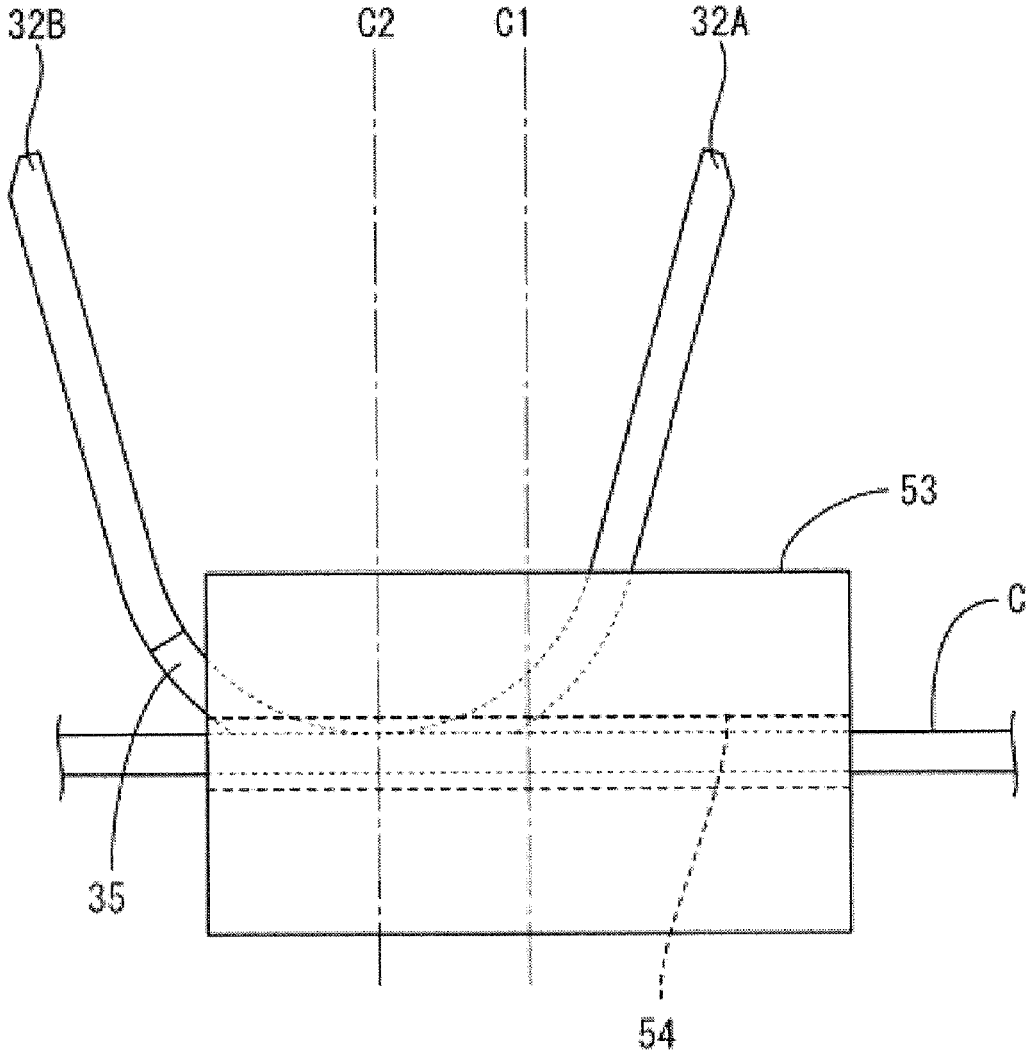
FIG. 5 is a rear view showing a state where the cutting mold is arranged in the escaping portion when viewed from behind.

As shown in FIG. 5, a center C1 of the cutting mold 53 in the width direction is offset toward the front crimping piece 32A from a center C2 between the crimping pieces 32A, 32B in the width direction. This offset avoids interference between the escaping portion 35 and the rear crimping piece 32B by shaping the crimping pieces 32A, 32B of the insulation barrel portion 32 into cross barrels where the barrels are offset in forward and backward directions FBD and the lateral edges of the crimping pieces 32A, 32B are inclined with respect to each other so that upon overlapping the crimping pieces 32A, 32B edges thereof cross each other. In other words, it is sufficient to form the escaping portion 35 only in the rear crimping piece 32B, and it is not necessary to form the escaping portion 35 in the front crimping piece 32A. Therefore, a reduction in the strength of the rear crimping piece 32B caused by partly cutting off the rear crimping piece 32B to form the escaping portion 35 is suppressed to a minimum level.

Figure 4:
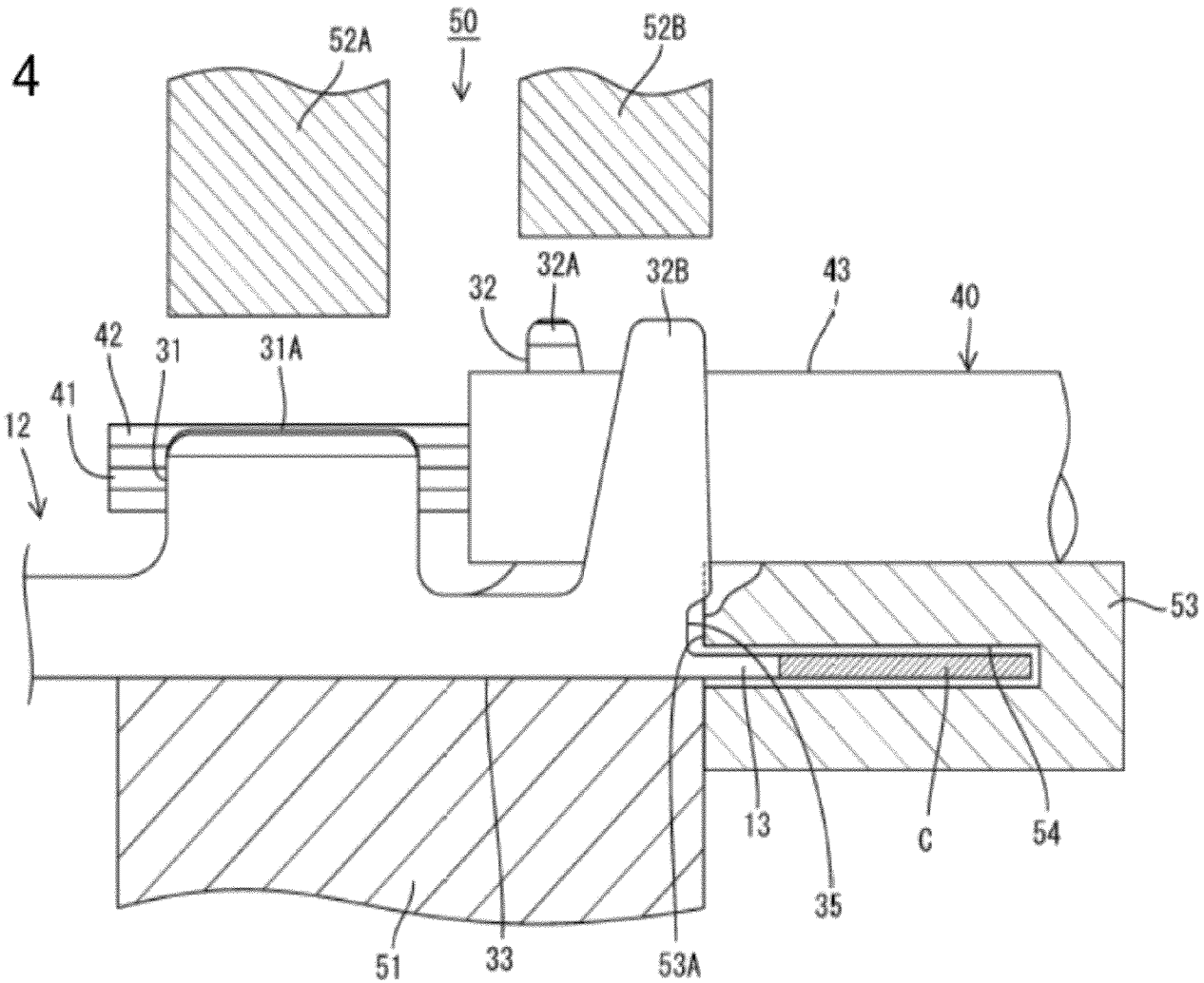
FIG. 4 is a side view partly in section showing a state before a crimping portion is crimped and a link portion is cut when viewed sideways.
Figure 6:
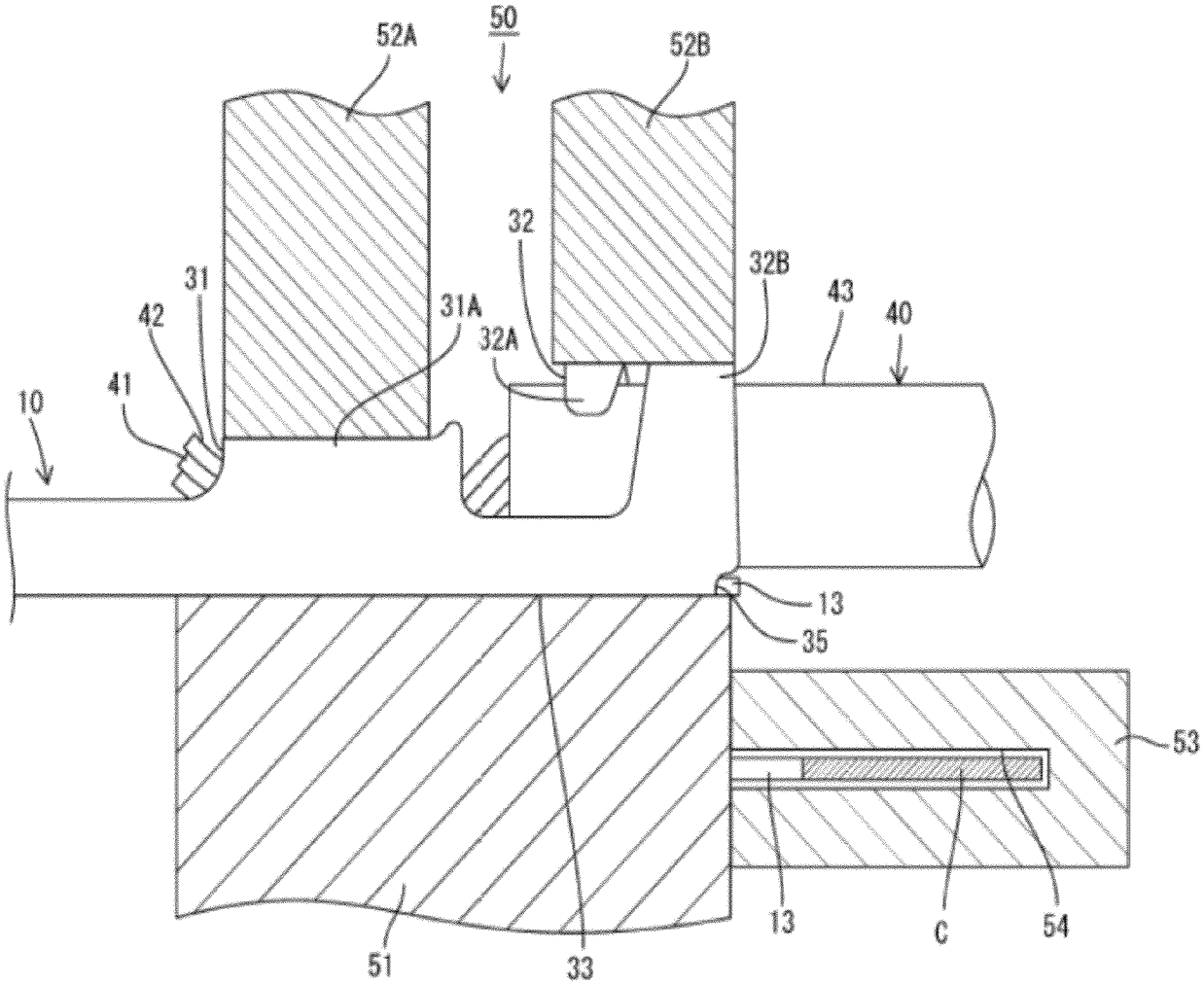
FIG. 6 is a section showing a state where the crimping portion is crimped and the link portion is cut when viewed sideways.
Figure 7:
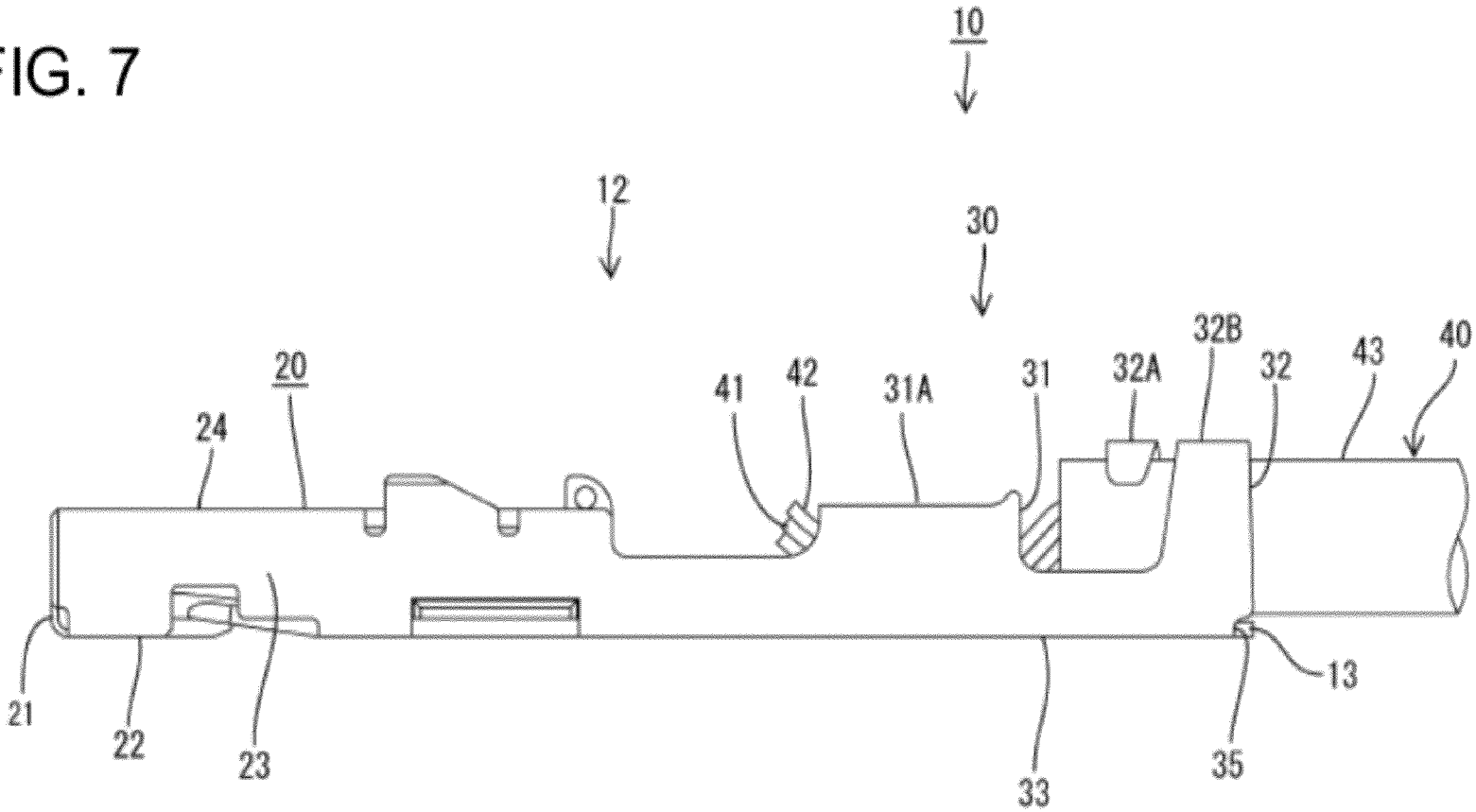
FIG. 7 is a side view of a wire with the terminal fitting.
Figure 8:
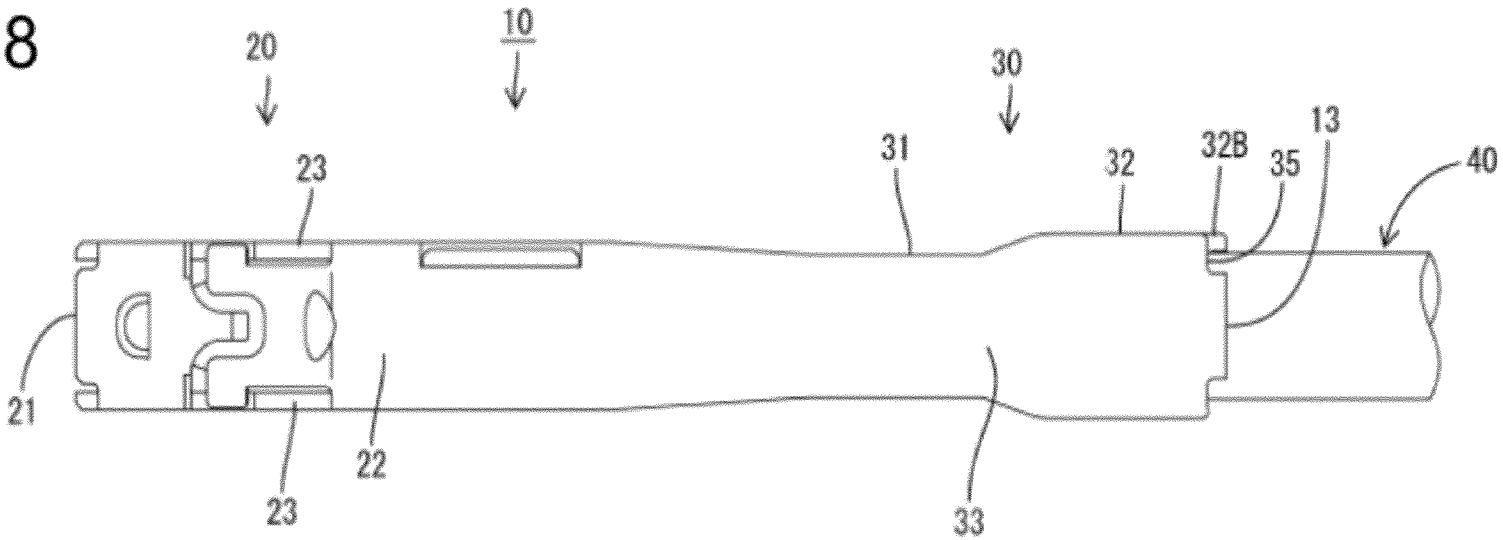
FIG. 8 is a bottom view of the wire with the terminal fitting.
Figure 9:
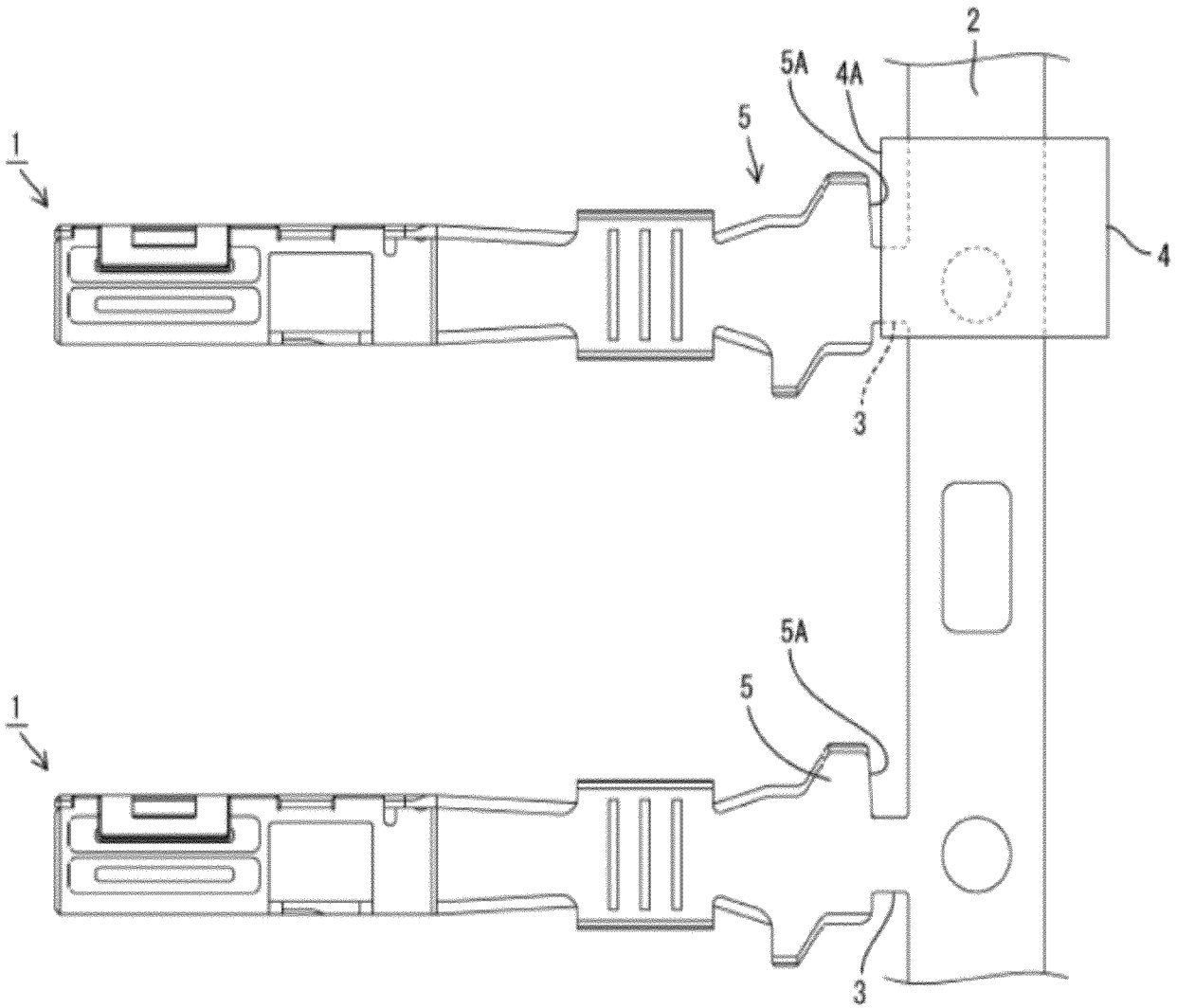
FIG. 9 is a plan view of a conventional terminal fitting coupled to a carrier before being crimped.
Figure 10:
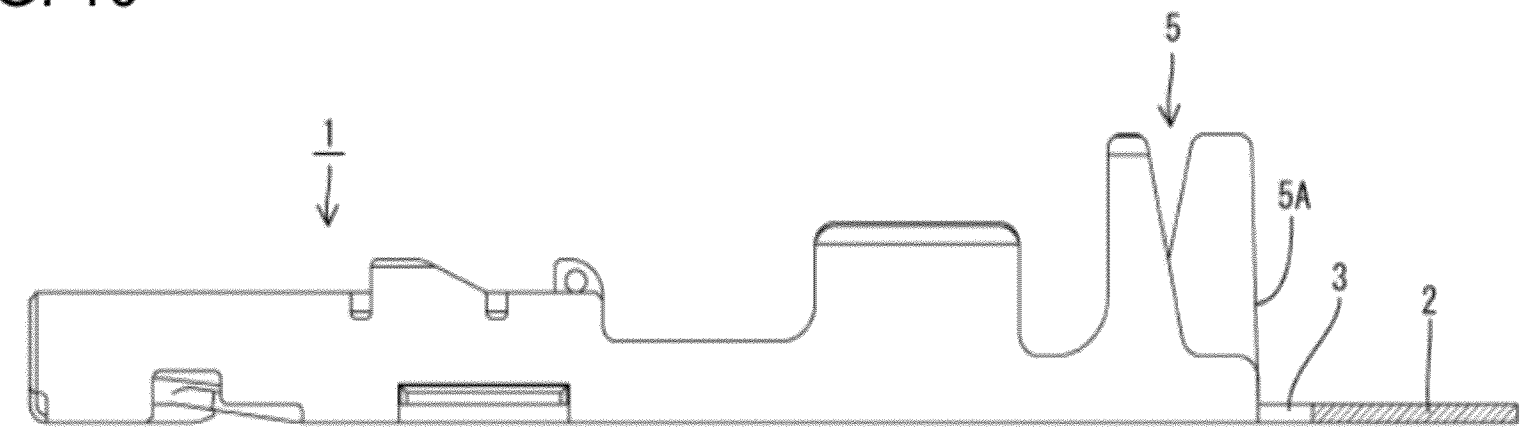
FIG. 10 is a side view of the conventional terminal fitting coupled to the carrier before being crimped.
Figure 11:
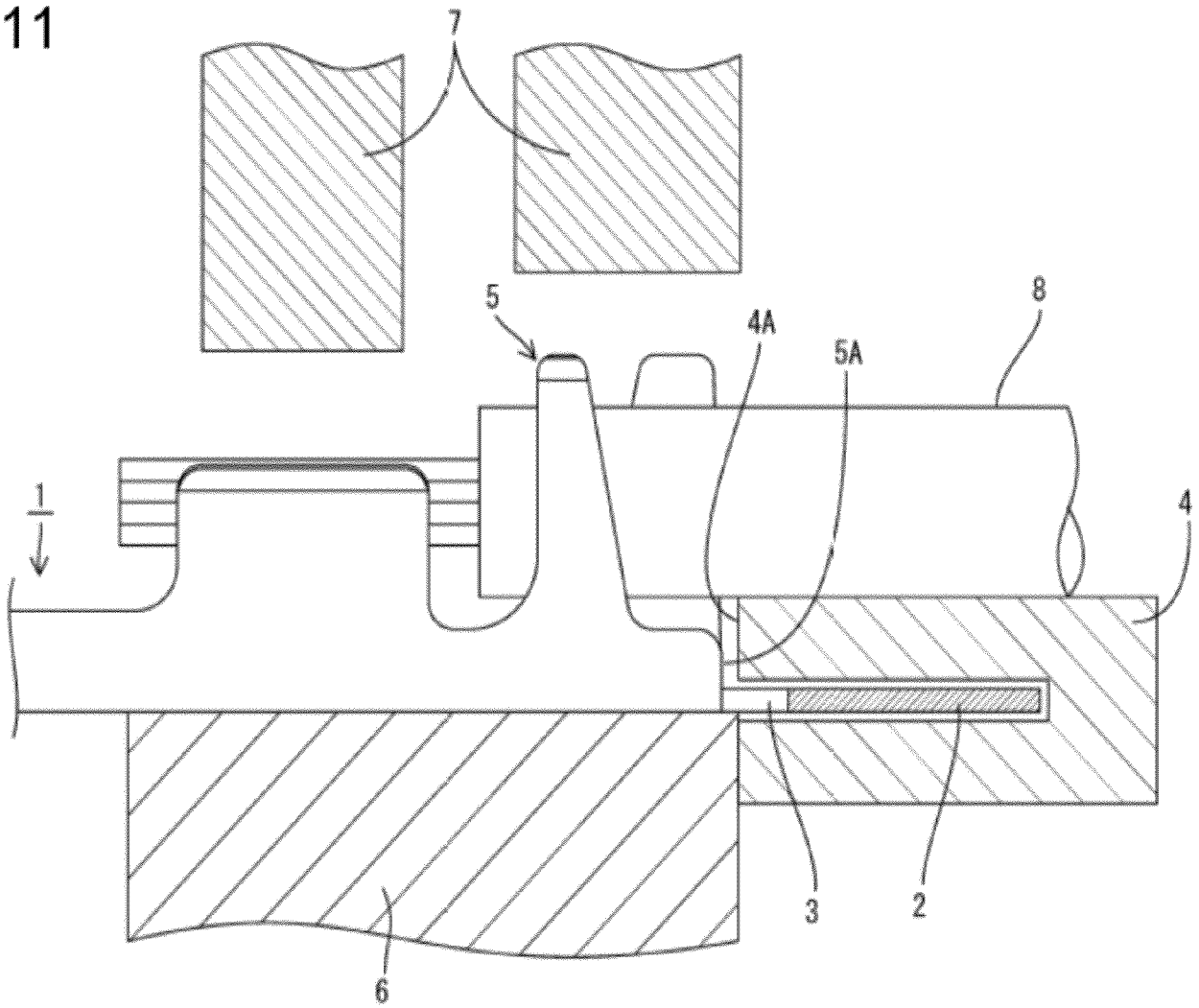
FIG. 11 is a section showing a state before a crimping portion is crimped and a link is cut in the conventional terminal fitting when viewed sideways.
Figure 12:
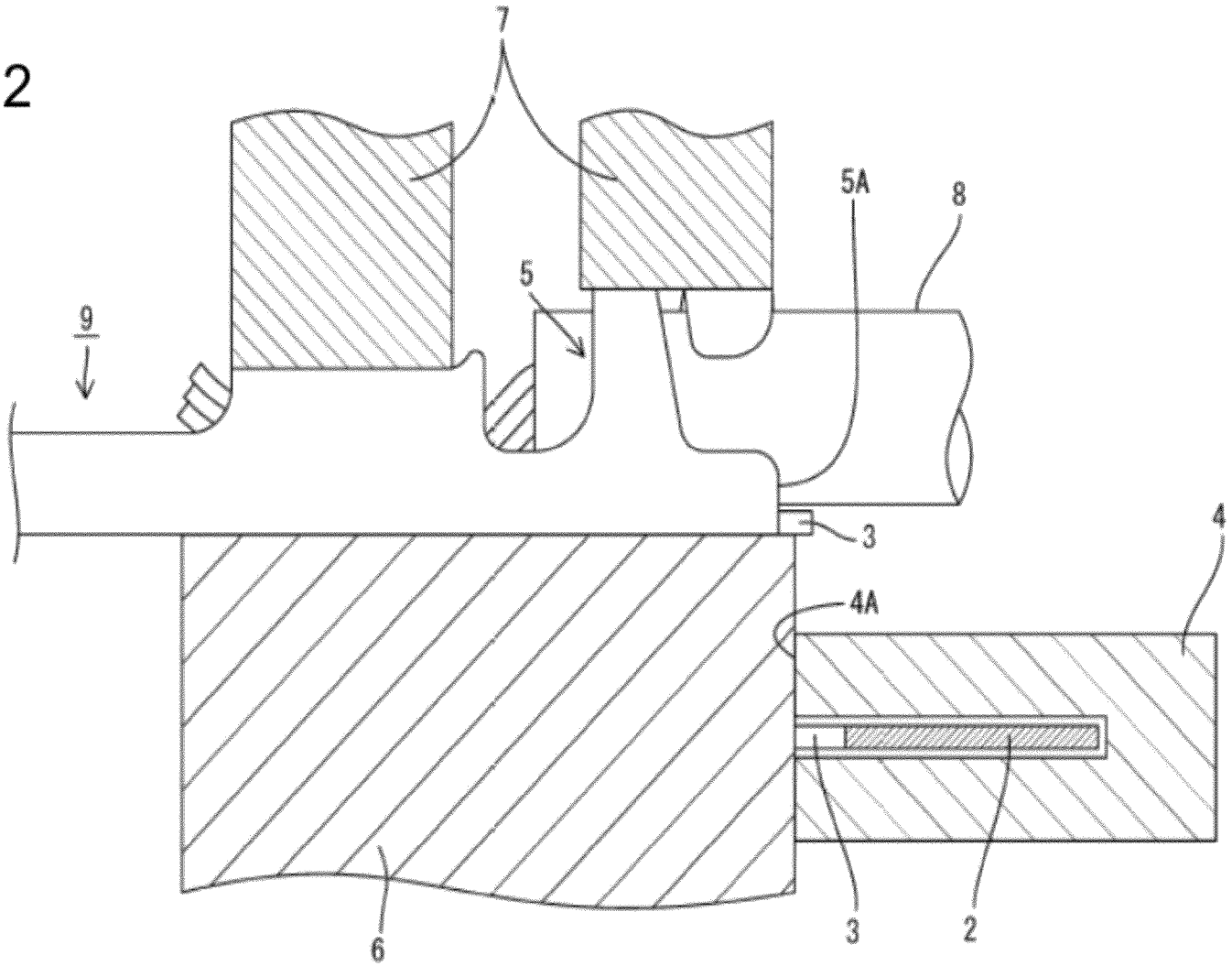
FIG. 12 is a section showing a state before the crimping portion is crimped and the link is cut in the conventional terminal fitting.
Figure 13:
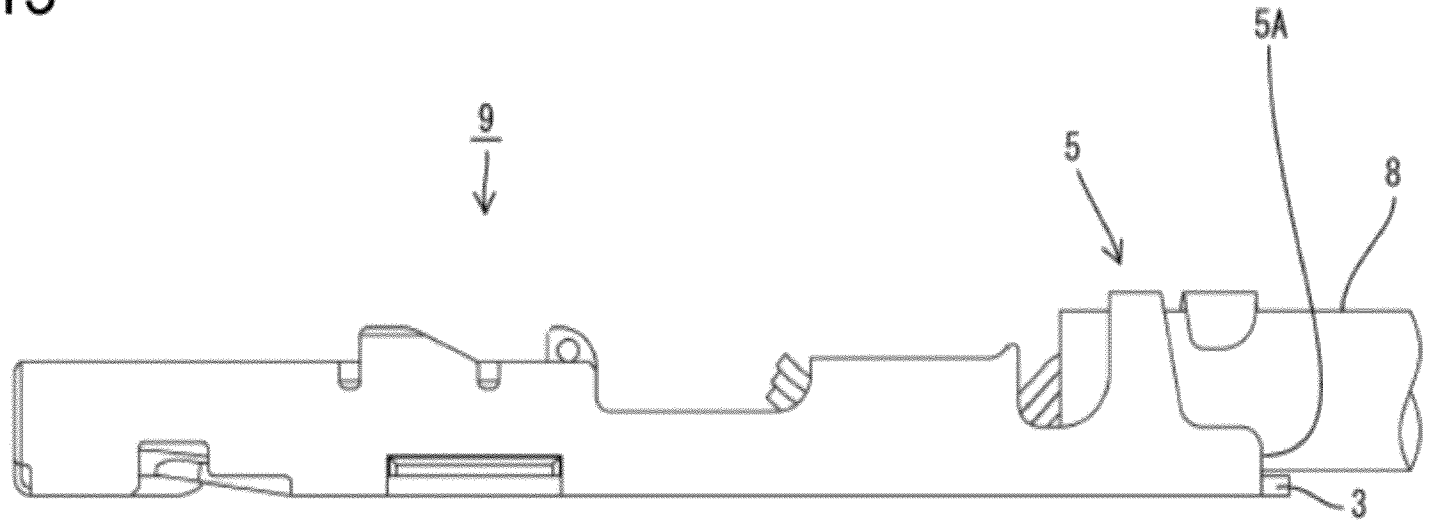
FIG. 13 is a side view of a conventional wire with the terminal fitting.

A main part of the crimping machine 50 for crimping the wire barrel 31 and the insulation barrel 32 is described with reference to FIGS. 4 to 6. As shown in FIG. 4, the wire barrel 31 and the insulation barrel 32 are placed on an anvil 51. A first crimper 52A corresponding to the wire barrel 31 and a second crimper 52B corresponding to the insulation barrel 32 are arranged above the anvil 51. The crimpers 52A, 52B are vertically movable toward and away from the anvil 51 by unillustrated driving means. Further, the cutting mold 53 is provided behind the terminal fitting 12.

The cutting mold 53 separates the carrier C from the terminal fitting 12 via the link 13. The cutting mold 53 is vertically movable toward and away from the anvil 51 while being held in contact with the rear end surface of the anvil 51. The front end 53A of the cutting mold 53 is arranged in the escaping portion 35 of the terminal fitting 11 coupled to the carrier C inserted into the crimping machine 50. The cutting mold 53 has a recess 54 that opens toward the front end 53A of the cutting mold 53. The carrier C is introduced into the recess 54 with the cutting mold 53 positioned at an upper position as shown in FIG. 4. The link 13 then is sheared by displacing the cutting mold 53.

The coating 43 is stripped off at the end of the insulated wire 40 to expose the core 42. Subsequently, as shown in FIG. 4, the core 42 is placed on the bottom wall 33 of the wire barrel 31 and the coating 43 is placed on the bottom wall 33 of the insulation barrel 32. Thereafter, as shown in FIG. 6, the crimpers 52A, 52B are lowered to crimp the wire barrel 31 and the insulation barrel 32. Substantially simultaneously, the cutting mold 53 is lowered to cut the link 13 and to separate the terminal fitting 10 from the carrier C.

The compression rate of the wire barrel 31 is set high. Thus, the wire barrel 31 is deformed plastically to elongate in forward and backward directions FBD. Accordingly, the link 13 projects back from the rear end of the anvil 51 as shown in FIG. 6. However, the link 13 is cut before the rear end of the rear crimping piece 32B. Thus, even if the link 13 projects back, the rear end thereof is, at the farthest, substantially aligns with the rear end of the rear crimping piece 32B.

As described above, the wire barrel 31 may elongate in forward and backward directions FBD upon crimping the wire barrel 31 at the high compression rate. However, the link 13 is cut before the rear end of the rear crimping piece 32B. Thus, the backward projecting distance of the link 13 can be suppressed. Therefore, it can be restricted that the links 13 project back from the cavities to hinder or contact adjacent wires with the terminal fittings 10.

The crimping pieces 32A, 32B of the insulation barrel 32 are shaped into cross barrels. Thus, the escaping portion 35 is only in the rear crimping piece 32B and is not in the front crimping piece 32A. Therefore, a reduction in the strength of the insulation barrel 32 can be suppressed to a minimum level. Further, since the core 42 preferably is made of aluminum alloy, the wire with the terminal fitting 10 can be made lighter as compared with a core 42 made of copper alloy.

The invention is not limited to the above described and illustrated embodiment. For example, the following embodiments are also included in the technical scope of the present invention.

Although the escaping portion 35 is only in the rear crimping piece 32B in the above embodiment, it may be formed in both crimping pieces 32A, 32B.

The rear end of the link 13 aligns with the rear end of the rear crimping piece 32B after the crimping operation in the above embodiment. However, the rear end of the link 13 may project slightly back from the rear end of the rear crimping piece 32B after the crimping operation according to the invention.

The crimping operation and the cutting operation are performed substantially simultaneously in the above embodiment. However, they may be performed at different timings by providing a small time lag.

Although the core 42 made of aluminum alloy is used in the above embodiment, a core made of copper alloy may be used according to the invention.

The cutting mold 53 is illustrated as a cutting device in the above embodiment. However, a blade such as a shear blade or a circular saw blade may be used as the cutting device or laser processing or the like may be performed.

Although the insulated wire 40 having a cross-sectional area of about 0.75 $mm^2$ is used in the above embodiment, the insulated wire is not limited to the insulated wire 40 and the one having a different cross-sectional area may be used. For example, the following insulated wires can be cited as such.

Aluminum wire 1 size: about 1.25 $mm^2$ (including sixteen metal strands 41)

Aluminum wire 2 size: about 2 $mm^2$ (including nineteen metal strands 41)

Aluminum wire 3 size: about 2.5 $mm^2$ (including nineteen metal strands 41)

Aluminum wire 4 size: about 3.0 $mm^2$ (including thirty seven metal strands 41)

What is claimed is:

1. A terminal fitting to be connected to a wire by crimping and being removably carried on a carrier, comprising:

a crimping portion to be crimped into connection with an end portion of a wire, the crimping portion having a bottom wall and front and rear crimping pieces extending from opposite sides of the bottom wall and being displaced from one another in forward and backward directions; and an escaping portion formed by cutting off part of a rear end of the rear crimping piece at a position substantially adjacent the bottom wall so that portions of the rear crimping piece spaced from the bottom wall project farther rearward than portions of the rear crimping piece at the escaping portion, whereby the escaping portion enables a cutting mold for cutting a link that couples the crimping portion to the carrier to be arranged at a position where a front end of the cutting mold is before the rear end of the crimping portion.

2. The terminal fitting of claim 1, wherein the front crimping piece is arranged before the front end of the cutting mold.

3. The terminal fitting of claim 1, wherein the crimping pieces are cross barrel crimping pieces.

4. The terminal fitting of claim 1, wherein at least one serration is formed in a surface to be held in contact with a core of the wire and is configured to bite in the core whereby a film with reduced electric conductivity on the core is scraped off by opening edges of the serration.

5. A terminal fitting chain comprising:

a carrier;

a plurality of links extending from the carrier; and a plurality of terminal fittings connected respectively to the carrier by the links, each of the terminal fittings having a crimping portion to be crimped into connection with an end portion of a wire, the crimping portion having a bottom wall extending from the respective link, front and rear crimping pieces extending from opposite sides of the bottom wall and displaced from one another in forward and backward directions, and an escaping portion formed by cutting off a part of a rear end of the rear crimping piece at a position substantially adjacent both the bottom wall and the link and facing the carrier, whereby a cutting mold for cutting the respective link that couples the crimping portion to the carrier to be arranged at a position where the front end of the cutting mold is before the rear end of the crimping portion.

6. The terminal fitting chain of claim 5, wherein feed holes are formed in the carrier at positions of the carrier substantially corresponding to the respective links for feeding the carrier.

7. An assembly of a wire and a terminal fitting, the terminal fitting having opposite front and rear ends, a crimping portion to be crimped into connection with an end portion of the wire, the crimping portion having a bottom wall and front and rear crimping pieces extending from opposite sides of the bottom wall and being displaced from one another in forward and backward directions, and an escaping portion formed by cutting off a part of a rear end of the rear crimping piece at a position substantially adjacent the bottom wall so that portions of the rear crimping piece spaced from the bottom wall project farther rearward than portions of the rear crimping piece at the escaping portion, whereby the escaping portion enables a cutting mold for cutting the link that couples the crimping portion to the carrier to be arranged at a position where the front end of the cutting mold is before the rear end of the crimping portion.

8. The wire with a terminal fitting of claim 7, wherein the wire has a core made of aluminum or aluminum alloy.

* * * * *